US009759481B2

(12) United States Patent
Paradowski et al.

(10) Patent No.: US 9,759,481 B2
(45) **Date of Patent: *Sep. 12, 2017**

(54) METHOD FOR PRODUCING A FLOW WHICH IS RICH IN METHANE AND A CUT WHICH IS RICH IN $C_2^+$ HYDROCARBONS FROM A FLOW OF FEED NATURAL GAS AND AN ASSOCIATED INSTALLATION

(71) Applicant: TECHNIP FRANCE, Courbevoie OT (FR)

(72) Inventors: Henri Paradowski, Pluvigner (FR); Sandra Thiebault, Coye-la-Foret (FR); Loic Barthe, Paris (FR)

(73) Assignee: TECHNIP FRANCE (FR)

( * ) Notice: Subject to any disclaimer, the term of this patent is extended or adjusted under 35 U.S.C. 154(b) by 315 days.

This patent is subject to a terminal disclaimer.

(21) Appl. No.: 14/269,656

(22) Filed: May 5, 2014

(65) Prior Publication Data

US 2014/0238075 A1 Aug. 28, 2014

Related U.S. Application Data

(62) Division of application No. 12/763,501, filed on Apr. 20, 2010, now Pat. No. 8,752,401.

(30) Foreign Application Priority Data

Apr. 21, 2009 (FR) ..... 09 52603

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01); *F25J 2200/02* (2013.01); *F25J 2200/70* (2013.01); *F25J 2200/76* (2013.01); *F25J 2205/04* (2013.01); *F25J 2210/04* (2013.01); *F25J 2210/06* (2013.01); *F25J 2230/24* (2013.01); *F25J 2230/60* (2013.01); *F25J 2235/60* (2013.01); *F25J 2240/02* (2013.01); *F25J 2245/02* (2013.01); *F25J 2270/04* (2013.01);
(Continued)

(58) Field of Classification Search
CPC ..... F25J 2200/70; F25J 2200/76
See application file for complete search history.

(56) References Cited

U.S. PATENT DOCUMENTS

| | | | | |
|---|---|---|---|---|
| 2,601,599 A | 6/1952 | Deming | ..... | 166/266 |
| 3,213,631 A | 10/1965 | Kneil | ..... | 62/622 |
| 3,363,426 A | 1/1968 | Stoklosinski | ..... | 62/651 |

(Continued)

*Primary Examiner* — Tareq Alosh
(74) *Attorney, Agent, or Firm* — Ostrolenk Faber LLP

(57) ABSTRACT

This method comprises cooling the feed natural gas in a first heat exchanger and introducing the cooled, feed natural gas into a first separation flask.

It comprises the dynamic expansion of a turbine supply flow in a first expansion turbine and introducing the expanded flow into a separation column. This method comprises removing, at the head of the separation column, a head flow rich in methane and removing a first recirculation flow from the compressed head flow rich in methane.

The method comprises forming at least a second recirculation flow obtained from the head flow rich in methane downstream of the separation column and forming a dynamic expansion flow from the second recirculation flow.

8 Claims, 7 Drawing Sheets

(52) U.S. Cl.
CPC ..... *F25J 2270/06* (2013.01); *F25J 2270/88* (2013.01); *F25J 2290/80* (2013.01)

(56) References Cited

U.S. PATENT DOCUMENTS

| | | | | |
|---|---|---|---|---|
| 3,675,435 | A | 7/1972 | Jackson et al. | 62/622 |
| 4,444,577 | A | 4/1984 | Perez | 62/622 |
| 4,687,499 | A | 8/1987 | Aghili | 62/621 |
| 4,889,545 | A | 12/1989 | Campbell et al. | 62/621 |
| 5,555,748 | A | 9/1996 | Campbell et al. | 62/621 |
| 5,600,969 | A | 2/1997 | Low | 62/622 |
| 6,363,744 | B2 | 4/2002 | Finn et al. | 62/621 |
| 6,578,379 | B2 | 6/2003 | Paradowski | 62/622 |
| 2004/0065113 | A1 | 4/2004 | Paradowski | 62/613 |
| 2006/0283207 | A1 | 12/2006 | Pitman et al. | 62/620 |
| 2007/0095099 | A1 | 5/2007 | Paradowski | 62/600 |
| 2008/0028790 | A1 | 2/2008 | Wilkinson et al. | 62/613 |
| 2008/0083246 | A1 | 4/2008 | Shah et al. | 62/630 |
| 2008/0190136 | A1 | 8/2008 | Pitman et al. | 62/620 |
| 2009/0113930 | A1 | 5/2009 | Patel et al. | 62/618 |

METHOD FOR PRODUCING A FLOW WHICH IS RICH IN METHANE AND A CUT WHICH IS RICH IN $C_2^+$ HYDROCARBONS FROM A FLOW OF FEED NATURAL GAS AND AN ASSOCIATED INSTALLATION

CROSS REFERENCE TO RELATED APPLICATIONS

The present application is a divisional under 37 C.F.R. §1.53(b) of prior U.S. patent application Ser. No. 12/763,501, filed Apr. 20, 2010, which claims priority of French Patent Application No. 0952603, filed Apr. 21, 2009, the contents of which are incorporated in full by reference herein.

BACKGROUND OF THE INVENTION

The present invention relates to a method for producing a flow which is rich in methane and a cut which is rich in $C_2^+$ hydrocarbons from a flow of dehydrated feed natural gas, the method being of the type comprising the following steps of:

- cooling the feed natural gas flow advantageously at a pressure greater than 40 bar in a first heat exchanger and introducing the cooled, feed natural gas flow into a first separation flask;
- separating the cooled natural gas flow in the first separation flask and recovering a light fraction which is substantially gaseous and a heavy fraction which is substantially liquid;
- dividing the light fraction into a flow for supplying to a turbine and a secondary flow;
- dynamic expansion of the turbine supply flow in a first expansion turbine and introducing the expanded flow into an intermediate portion of a separation column;
- cooling the secondary flow in a second heat exchanger and introducing the cooled secondary flow into an upper portion of the separation column;
- expanding of the heavy fraction, vaporisation in the first heat exchanger and introduction into a second separation flask in order to form a head fraction and a bottom fraction;
- introducing the head fraction, after cooling in the second heat exchanger, in the upper portion of the separation column;
- introducing the bottom fraction into an intermediate portion of the separation column;
- recovering, at the bottom of the separation column, a bottom flow which is rich in $C_2^+$ hydrocarbons and which is intended to form the cut rich in $C_2^+$ hydrocarbons;
- removing, at the head of the separation column, a head flow rich in methane;
- reheating the head flow rich in methane in the second heat exchanger and in the first heat exchanger and compressing that flow in at least a first compressor which is connected to the first expansion turbine and in a second compressor in order to form a flow rich in methane from the compressed head flow rich in methane;
- removing a first recirculation flow from the head flow rich in methane; and
- passing the first recirculation flow into the first heat exchanger and into the second heat exchanger in order to cool it, then introducing at least a first portion of the first cooled recirculation flow into the upper portion of the separation column.

Such a method is intended to be used to construct new units for producing a flow which is rich in methane and a cut of $C_2^+$ hydrocarbons from a feed natural gas, or in order to modify existing units, in particular when the feed natural gas has a high content of ethane, propane and butane.

Such a method is also used when it is difficult to carry out cooling of the feed natural gas by means of an external cooling cycle using propane, or when the installation of such a cycle would be too expensive or too dangerous, as in, for example, floating plants or in built-up regions.

Such a method is particularly advantageous when the unit for fractionating the cut of $C_2^+$ hydrocarbons which produces the propane which is intended to be used in the cooling cycles is too far from the unit for recovering that cut of $C_2^+$ hydrocarbons.

Separating the cut of $C_2^+$ hydrocarbons from a natural gas extracted from underground allows economic imperatives and technical imperatives alike to be satisfied.

Indeed, the cut of $C_2^+$ hydrocarbons recovered from the natural gas is advantageously used to produce ethane and liquids which constitute raw petrochemical materials. It is further possible to produce, from a cut of $C_2^+$ hydrocarbons, cuts of $C_5^+$ hydrocarbons which are used in oil refineries. All these products can be exploited economically and contribute to the profitability of the installation.

Technically, the demands placed on natural gas supplied commercially via networks include, in some cases, a specification in terms of the calorific power which must be relatively low.

Methods for producing a cut of $C_2^+$ hydrocarbons generally comprise a distillation step, after the feed natural gas has been cooled, in order to form a head flow which is rich in methane and a bottom flow which is rich in $C_2^+$ hydrocarbons.

In order to improve the selectivity of the method, it is known to remove a portion of the flow rich in methane produced at the column head, after compression, and to reintroduce it, after cooling, at the column head, in order to constitute a reflux of this column. Such a method is described, for example, in US2008/0190136 or in U.S. Pat. No. 6,578,379.

Such methods allow recovery of ethane to be obtained that is greater than 95% and, in the latter case, even greater than 99%.

However, such a method is not completely satisfactory when the feed natural gas is very rich in heavy hydrocarbons and in particular ethane, propane and butane, and when the introduction temperature of the feed natural gas is relatively high.

In such cases, the quantity of cooling to be provided is high, which requires the addition of a supplementary cooling cycle if it is desirable to maintain good selectivity. Such a cycle consumes energy. In some installations, in particular floating installations, it is further not possible to implement such cooling cycles.

SUMMARY OF THE INVENTION

Therefore, an object of the invention is to provide a method which is for recovering $C_2^+$ hydrocarbons and which is extremely efficient and very selective, even when the content, in the feed natural gas, of those $C_2^+$ hydrocarbons increases significantly.

To that end, the invention relates to a method of the above-mentioned type, characterised in that the method comprises the following steps of:

forming at least a second recirculation flow obtained from the head flow rich in methane downstream of the separation column;

forming a dynamic expansion flow from the second recirculation flow and introducing the dynamic expansion flow into an expansion turbine in order to produce frigories.

The method according to the invention may comprise one or more of the following features taken in isolation or in accordance with any technically possible combination:

the second recirculation flow is introduced into a flow downstream of the first heat exchanger and upstream of the first expansion turbine in order to form the dynamic expansion flow;

the second recirculation flow is mixed with the turbine supply flow from the first separation flask in order to form the dynamic expansion flow, the dynamic expansion turbine receiving the dynamic expansion flow being formed by the first expansion turbine;

the second recirculation flow is mixed with the cooled natural gas flow before it is introduced into the first separation flask, the dynamic expansion flow being formed by the turbine supply flow from the first separation flask;

the second recirculation flow is removed from the first recirculation flow;

the method comprises the following steps of:

removing a removal flow from the head flow rich in methane, before it is introduced into the first compressor and the second compressor;

compressing the removal flow in a third compressor and forming the second recirculation flow from the compressed removal flow from the third compressor, after cooling;

the method comprises passing the removal flow into a third heat exchanger and into a fourth heat exchanger before it is introduced into the third compressor, then passing the compressed removal flow into the fourth heat exchanger, then into the third heat exchanger in order to supply the head of the separation column, the second recirculation flow being removed from the cooled, compressed removal flow, between the fourth heat exchanger and the third heat exchanger;

the removal flow is introduced into a fourth compressor, the method comprising the following steps of:

removing a secondary branch flow from the cooled, compressed removal flow from the third compressor and the fourth compressor;

dynamic expansion of the secondary branch flow in a second expansion turbine which is connected to the fourth compressor;

introducing the expanded secondary branch flow into the removal flow before it is passed into the third compressor and into the fourth compressor;

the second recirculation flow is removed from the compressed head flow rich in methane, the method comprising the following steps of:

introducing the second recirculation flow into a third heat exchanger;

separating the feed natural gas flow into a first feed flow and a second feed flow;

placing the second feed flow in a heat exchange ratio with the second recirculation flow in the third heat exchanger;

mixing the second feed flow after cooling in the third heat exchanger with the first feed flow, downstream of the first exchanger and upstream of the first separation flask;

the method comprises the following steps of:

removing a secondary cooling flow from the compressed head flow rich in methane, downstream of the first compressor and downstream of the second compressor;

dynamic expansion of the secondary cooling flow in a second expansion turbine and introduction of the expanded secondary cooling flow into the third heat exchanger in order to place it in a heat exchange ratio with the second feed flow and the second recirculation flow;

reintroducing the expanded secondary cooling flow into the flow rich in methane before it is introduced into the first compressor and into the second compressor;

removing a recompression fraction from the cooled flow rich in methane downstream of the introduction of the expanded secondary cooling flow and upstream of the first compressor and the second compressor;

compressing the recompression fraction in at least one compressor connected to the second expansion turbine and reintroducing the compressed recompression fraction into the compressed flow rich in methane from the first compressor and the second compressor;

the second recirculation flow is branched off from the first recirculation flow in order to form the dynamic expansion flow, the dynamic expansion flow being introduced into a second expansion turbine separate from the first expansion turbine, the dynamic expansion flow from the second expansion turbine being reintroduced into the flow rich in methane before it is introduced into the first heat exchanger;

the method comprises the following steps of:

removing a recompression fraction from the reheated head flow rich in methane from the first heat exchanger and the second heat exchanger;

compressing the recompression fraction in a third compressor which is connected to the second expansion turbine;

introducing the compressed recompression fraction into the compressed flow rich in methane from the first compressor;

the method comprises the branching-off of a third recirculation flow, advantageously at ambient temperature, from the at least partially compressed flow rich in methane, advantageously between two stages of the second compressor, the third recirculation flow being cooled successively in the first heat exchanger and in the second heat exchanger before being mixed with the first recirculation flow in order to be introduced into the separation column;

the bottom flow rich in $C_2^+$ hydrocarbons is pumped and is reheated by counter-current heat exchange of at least a portion of the feed natural gas flow, advantageously up to a temperature less than or equal to the temperature of the feed natural gas flow before it is introduced into the first heat exchanger;

the pressure of the flow rich in $C_2^+$ hydrocarbons after pumping is selected to keep the flow rich in $C_2^+$ hydrocarbons, after reheating in the first heat exchanger, in liquid form;

the molar flow rate of the second recirculation flow is greater than 10% of the molar flow rate of the feed natural gas flow;

the temperature of the second recirculation flow is substantially equal to the temperature of the cooled natural gas flow introduced into the first separation flask;

the pressure of the third recirculation flow is less than the pressure of the feed natural gas flow and is greater than the pressure of the separation column;

the molar flow rate of the third recirculation flow is greater than 10% of the molar flow rate of the feed natural gas flow;

the molar flow rate of the removal flow is greater than 4%, advantageously greater than 10%, of the molar flow rate of the feed natural gas flow;

the temperature of the removal flow, after being introduced into the third heat exchanger, is less than that of the cooled feed natural gas flow supplied to the first separation flask;

the molar flow rate of the secondary branch flow is greater than 10% of the molar flow rate of the feed natural gas flow;

the molar flow rate of the secondary cooling flow is greater than 10% of the molar flow rate of the feed natural gas flow;

the pressure of the expanded secondary cooling flow is greater than 15 bar;

the ratio between the flow rate of ethane contained in the cut rich in $C_2^+$ hydrocarbons and the flow rate of ethane contained in the feed natural gas is greater than 0.98;

the ratio between the $C_3^+$ hydrocarbon flow rate contained in the cut rich in $C_2^+$ hydrocarbons and the $C_3^+$ hydrocarbon flow rate contained in the feed natural gas is greater than 0.998.

The invention also relates to an installation for producing a flow rich in methane and a cut rich in $C_2^+$ hydrocarbons from a dehydrated feed natural gas flow which is composed of hydrocarbons, nitrogen and $CO_2$ and which advantageously has a molar content of $C_2^+$ hydrocarbons greater than 10%, the installation being of the type comprising:

a first heat exchanger for cooling the feed natural gas flow which advantageously flows at a pressure greater than 40 bar;

a first separation flask;

means for introducing the cooled feed natural gas flow into the first separation flask, the flow of cooled natural gas being separated in the first separation flask in order to recover a light, substantially gaseous fraction and a heavy, substantially liquid fraction;

means for dividing the light fraction into a flow for supplying a turbine and a secondary flow;

a first dynamic expansion turbine for the turbine supply flow;

a separation column;

means for introducing the expanded flow into the first dynamic expansion turbine in an intermediate portion of the separation column;

a second heat exchanger for cooling the secondary flow and means for introducing the cooled secondary flow in an upper portion of the separation column;

means for expanding the heavy fraction and means for passing the heavy fraction through the first heat exchanger;

a second separation flask;

means for introducing the heavy fraction from the first heat exchanger into the second separation flask in order to form a head fraction and a bottom fraction;

means for introducing the head fraction, after it has been introduced into the second exchanger to cool it, into the upper portion of the separation column;

means for introducing the bottom fraction into an intermediate portion of the separation column;

means for recovering, at the bottom of the separation column, a bottom flow which is rich in $C_2^+$ hydrocarbons and which is intended to form the cut rich in $C_2^+$ hydrocarbons;

means for removing, at the head of the separation column, a head flow rich in methane;

means for introducing the head flow rich in methane into the second heat exchanger and into the first heat exchanger in order to reheat it;

means for compressing the head flow rich in methane comprising at least a first compressor which is connected to the first turbine and a second compressor in order to form the flow rich in methane from the compressed head flow rich in methane;

means for removing a first recirculation flow from the head flow rich in methane;

means for passing the first recirculation flow through the first heat exchanger then into the second heat exchanger in order to cool it;

means for introducing at least a portion of the first cooled recirculation flow into the upper portion of the separation column;

characterised in that the installation comprises:

means for forming at least a second recirculation flow obtained from the head flow rich in methane downstream of the separation column;

means for forming a dynamic expansion flow from the second recirculation flow;

means for introducing the dynamic expansion flow into an expansion turbine in order to produce frigories.

In one embodiment, the means for forming a dynamic expansion flow from the second recirculation flow comprise means for introducing the second recirculation flow into a flow which flows downstream of the first heat exchanger and upstream of the first expansion turbine in order to form the dynamic expansion flow.

The term "ambient temperature" is intended to refer below to the temperature of the gaseous atmosphere which prevails in the installation in which the method according to the invention is carried out. This temperature is generally between −40° C. and 60° C.

The invention will be better understood from a reading of the following description, given purely by way of example and with reference to the appended drawings, in which:

DESCRIPTION OF PREFERRED EMBODIMENTS

Figure 1:
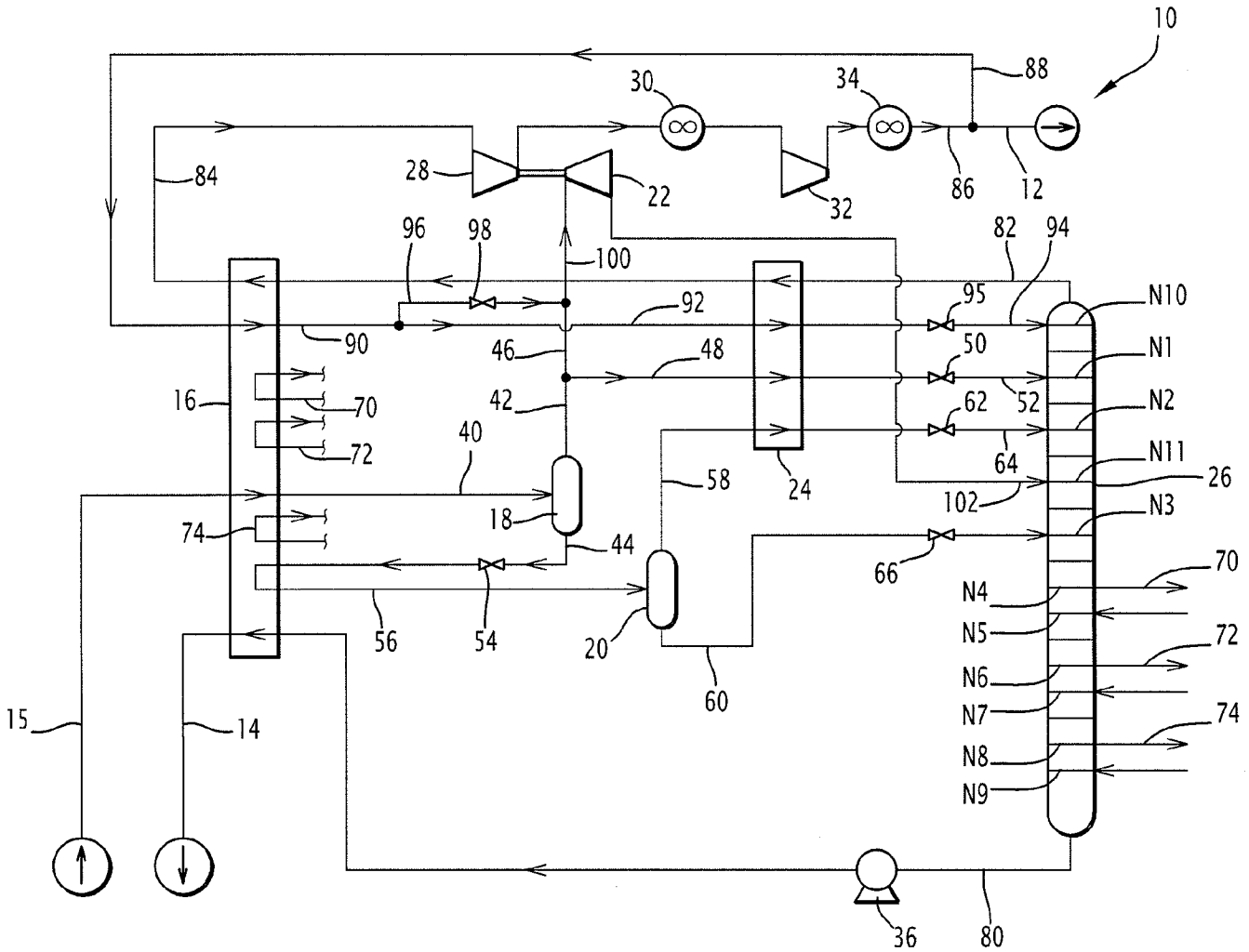
FIG. 1 is a schematic drawing of a first installation according to the invention for carrying out a first method according to the invention.

FIG. 1 illustrates a first installation 10 for producing a flow 12 rich in methane and a cut 14 rich in $C_2^+$ hydrocarbons according to the invention from a feed natural gas 15. This installation 10 is intended for carrying out a first method according to the invention.

The method and the installation 10 are advantageously used in the construction of a new unit for recovering methane and ethane.

The installation 10 comprises, in a downstream direction, a first heat exchanger 16, a first separation flask 18, a second separation flask 20, a first expansion turbine 22 and a second heat exchanger 24.

The installation 10 further comprises a separation column 26 and, downstream of the column 26, a first compressor 28 which is connected to the first expansion turbine 22, a first air cooler 30, a second compressor 32 and a second air cooler 34. The installation 10 further comprises a column bottom pump 36.

Hereinafter, the same reference numerals will be used to indicate a flow flowing in a conduit and the conduit which conveys it. Unless otherwise indicated, the percentages set out are further molar percentages and the pressures are given in absolute bar.

Furthermore, the efficiency of each compressor is 82% polytropic and the efficiency of each turbine is 85% adiabatic.

A first production method according to the invention carried out in the installation 10 will now be described.

The feed natural gas 15 is, in this example, a dehydrated and decarbonated natural gas comprising, in moles, 0.3499% of nitrogen, 80.0305% of methane, 11.3333% of ethane, 3.6000% of propane, 1.6366% of i-butane, 2.0000% of n-butane, 0.2399% of i-pentane, 0.1899% of n-pentane, 0.1899% of n-hexane, 0.1000% of n-heptane, 0.0300% of n-octane and 0.3000% of carbon dioxide.

The feed natural gas 15 therefore more generally comprises, in moles, between 10% and 25% of $C_2^+$ hydrocarbons to be recovered and between 74% and 89% of methane. The content of $C_2^+$ hydrocarbons is advantageously greater than 15%.

The term decarbonated gas is intended to refer to a gas whose content in terms of carbon dioxide is lowered so as to avoid the crystallisation of the carbon dioxide, this content generally being less than 1 mol %.

The term dehydrated gas is intended to refer to a gas whose content of water is as low as possible and in particular less than 1 ppm.

The content of hydrogen sulphide of the feed natural gas 15 is further preferably less than 10 ppm and the content of sulphur-containing compounds of the mercaptan type is preferably less than 30 ppm.

The feed natural gas has a pressure greater than 40 bar and in particular substantially of 62 bar. It further has a temperature of approximately ambient temperature and in particular of 40° C. The flow rate of the feed natural gas flow 15 is 15000 kgmol/h in this example.

The feed natural gas flow 15 is firstly introduced into the first heat exchanger 16, where it is cooled and partially condensed at a temperature greater than −50° C. and in particular substantially of −30° C. in order to provide a cooled, feed natural gas flow 40 which is introduced in its entirety into the first separation flask 18.

In the first separation flask 18, the cooled, feed natural gas flow 40 is separated into a light gaseous fraction 42 and a heavy liquid fraction 44.

The ratio of the molar flow rate of the light fraction 42 to the molar flow rate of the heavy fraction 44 is generally between 4 and 10.

Subsequently, the light fraction 42 is separated into a supply flow 46 for the first expansion turbine and a secondary flow 48 which is introduced successively into the heat exchanger 24 and into a first static expansion valve 50 in order to form an expanded, cooled and at least partially liquefied secondary flow 52.

The expanded, cooled secondary flow 52 is introduced at a higher level N1 of the separation column 26 corresponding to the fifth stage from the top of the column 26.

The flow rate of the secondary flow 48 constitutes less than 20% of the flow rate of the light fraction 42.

The pressure of the secondary flow 52, after expansion thereof in the valve 50, is less than 20 bar and particularly of 18 bar. This pressure corresponds substantially to the pressure of the column 26 which is more generally greater than 15 bar, advantageously between 15 bar and 25 bar.

The expanded, cooled secondary flow 52 comprises a molar content of ethane greater than 5% and particularly substantially of 8.9 mol % of ethane.

The heavy fraction 44 is directed towards a second level control valve 54 which opens in accordance with the level of liquid in the first separation flask 18, then is introduced into the first heat exchanger 16 in order to be reheated up to a temperature greater than −50° C. and particularly of −38° C. in order to obtain a reheated heavy fraction 56.

The reheated heavy fraction 56 is subsequently introduced into the second separation flask 20 in order to form a substantially gaseous head fraction 58 and a substantially liquid bottom fraction 60.

The ratio of the molar flow rate of the head fraction 58 to the molar flow rate of the bottom fraction 60 is, for example, between 0.30 and 0.70.

Subsequently, the head fraction 58 is introduced into the second heat exchanger 24 in order to be liquefied at that location and to provide, after expansion in a pressure control valve 62, an expanded, cooled and at least partially liquid head fraction 64 which is introduced at a higher level N2 of the column 26 that is below the level N1 and corresponds to the sixth stage from the top of the column 26.

The pressure of the fraction 64 is substantially equal to the pressure of the column 26. The temperature of that fraction 64 is greater than −115° C. and particularly substantially of −107.4° C.

The liquid bottom fraction 60 passes via a level control valve 66 which opens in accordance with the liquid level in the second separation flask 20. The bottom fraction 60 is subsequently introduced at a level N3 of the column below the level N2 at the twelfth stage of the column 26 from the top.

An upper reboiling flow 70 is removed at a bottom level N4 of the column 26 below the level N3 and corresponding to the thirteenth stage from the top of the column 26. The reboiling flow is provided at a temperature greater than −55°

C. and is passed into the first heat exchanger 16 in order to be partially vaporised therein and to exchange thermal power of approximately 3948 kW with the other flows flowing in the exchanger 16.

The partially vaporised, liquid reboiling flow is reheated to a temperature greater than −40° C. and in particular of −28.8° C., and is conveyed to the level N5 that is just below the level N4 and corresponds to the fourteenth stage of the column 26 from the top.

The liquid removed at that stage is mainly composed of 18.78 mol % of methane and 51.38 mol % of ethane.

A second intermediate reboiling flow 72 is collected at a level N6 that is below the level N5 and corresponds to the nineteenth stage from the top of the column 26. The second reboiling flow 72 is removed at a temperature greater than −20° C. in order to be conveyed into the first exchanger 16 and to exchange thermal power of 1500 kW with the other flows flowing in the exchanger 16.

The reboiling flow of the partially vaporised liquid from the exchanger 16 is then reintroduced at a temperature greater than −15° C. and in particular of −5.6° C. at a level N7 just below the level N6 and in particular at the twentieth stage from the top of the column 26.

The intermediate reboiling flow 72 is mainly composed of 4.91 mol % of methane and 61.06 mol % of ethane.

A third lower reboiling flow 74 is further removed at a level N8 of the column 26 below the level N7 and, for example, at the twenty-second stage from the top of the column 26 at a temperature greater than −10° C. and in particular of 1.6° C.

The lower reboiling flow 74 is then conveyed as far as the heat exchanger 16 in order to be partially vaporised therein and to exchange thermal power of 2850 kW with the other flows flowing in the exchanger 16.

The partially vaporised liquid flow is conveyed to a level N9 that is just below the level N8 and corresponds to the twenty-third stage from the top of the column 26.

A flow 80 rich in $C_2^+$ hydrocarbons is removed from the bottom of the column 26 at a temperature greater than −5° C. and in particular of 8.2° C. The flow comprises less than 1% of methane and more than 98% of $C_2^+$ hydrocarbons. It contains more than 99% of the $C_2^+$ hydrocarbons of the feed natural gas flow 15.

In the example illustrated, the flow 80 contains, in moles, 0.57% of methane, 57.76% of ethane, 18.5% of propane, 8.41% of i-butane, 10.28% of n-butane, 1.23% of i-pentane, 0.98% of n-pentane, 0.98% of n-hexane, 0.51% of n-heptane, 0.15% of n-octane, 0.63% of carbon dioxide.

The liquid flow 80 is pumped in the column bottom pump 36 and is then introduced into the first heat exchanger 16 in order to be reheated therein up to a temperature greater than 25° C. and remains in the liquid state. It thereby produces the cut 14 rich in $C_2^+$ hydrocarbons at a pressure greater than 25 bar and in particular of 30.8 bar, advantageously at 37° C.

A head flow 82 rich in methane is produced at the head of the column 26. The head flow 82 comprises a molar content greater than 99.2% of methane and a molar content less than 0.15% of ethane. It contains more than 99.8% of the methane contained in the feed natural gas 15.

The head flow 82 rich in methane is successively reheated in the second heat exchanger 24, then in the first heat exchanger 16 in order to provide a head flow 84 rich in methane reheated to a temperature less than 40° C. and in particular of 37.4° C.

The flow 84 is first compressed in the first compressor 28, then is cooled in the first air cooler 30. It is subsequently compressed for a second time in the second compressor 32 and is cooled in the second air cooler 34 in order to provide a compressed head flow 86 rich in methane.

The temperature of the compressed flow 86 is substantially 40° C. and its pressure is greater than 60 bar, and is particularly substantially of 63.06 bar.

The compressed flow 86 is subsequently separated into a flow 12 rich in methane produced by the installation 10 and a first recirculation flow 88.

The ratio of the molar flow rate of the flow 12 rich in methane relative to the molar flow rate of the first recirculation flow is greater than 1 and is particularly between 1 and 20.

The flow 12 comprises a methane content of greater than 99.2%. In the example, it is composed of more than 99.23 mol % of methane, 0.11 mol % of ethane, 0.43 mol % of nitrogen and 0.22 mol % of carbon dioxide. The flow 12 is subsequently conveyed in a gas pipeline.

The first recirculation flow 88 rich in methane is then directed towards the first heat exchanger 16 in order to provide the first cooled recirculation flow 90 at a temperature of less than −30° C. and in particular of −45° C.

A first portion 92 of the first cooled recirculation flow 90 is subsequently introduced into the second exchanger 24 in order to be liquefied therein before travelling through the flow control valve 95 and forming a first cooled and at least partially liquefied portion 94 which is introduced at a level N10 of the column 26 above the level N1, in particular at the first stage of this column from the top. The temperature of the first cooled portion 94 is greater than −120° C. and in particular of −111° C. Its pressure, after being introduced into the valve 95, is substantially equal to the pressure of the column 26.

According to the invention, a second portion 96 of the first cooled recirculation flow 90 is removed in order to form a second recirculation flow rich in methane.

That second portion 96 is expanded in an expansion valve 98 before being mixed with the turbine supply flow 46 in order to form a supply flow 100 for the first expansion turbine 22 which is intended to be expanded dynamically in that turbine 22 in order to produce frigories.

The supply flow 100 is expanded in the turbine 22 in order to form an expanded flow 102 which is introduced into the column 26 at a level N11 between the level N2 and the level N3, in particular at the tenth stage from the top of the column at a pressure of substantially 17.9 bar.

The dynamic expansion of the flow 100 in the turbine 22 allows recovery of 5176 kW of energy, which results for a fraction greater than 50% and in particular of 75% of the turbine supply flow 46 and for a fraction less than 50% and in particular of 25% of the second recirculation flow.

Therefore, the flow 100 forms a dynamic expansion flow which produces frigories owing to its expansion in the turbine 22.

In relation to an installation of the prior art, in which the whole of the first recirculation flow 90 is reintroduced into the column 26, the method according to the invention allows recovery of ethane to be achieved that is identical, greater than 99%, whilst substantially reducing the power to be provided by the second compressor 32 from 20310 kW to 19870 kW.

The column 26 further operates at a relatively high pressure which makes the method less sensitive to the crystallisation of impurities, such as carbon dioxide and heavy hydrocarbons, whilst retaining a very high rate of recovery of ethane. The improvement in the efficiency of the installation is shown by Table 1 below.

TABLE 1

| Recovery of ethane mol % | Flow rate of the second recycled flow 96 at turbine 22 kgmol/h | Power of compressor 32 kW | Pressure of column 26 bar |
|---|---|---|---|
| 99.22 | 0 | 20310 | 14.30 |
| 99.23 | 100 | 20250 | 14.50 |
| 99.26 | 500 | 20160 | 15.00 |
| 99.25 | 1000 | 20050 | 15.50 |
| 99.22 | 1500 | 19960 | 16.00 |
| 99.24 | 2000 | 19880 | 16.50 |
| 99.22 | 2500 | 19880 | 17.00 |
| 99.26 | 3000 | 19880 | 17.50 |
| 99.19 | 3500 | 19870 | 18.00 |
| 99.21 | 4000 | 19940 | 18.50 |

Examples of temperature, pressure and molar flow rate of the various flows are set out in Table 2 below.

TABLE 2

| Flow | Temperature (° C.) | Pressure (bar) | Flow rate (kgmol/h) |
|---|---|---|---|
| 12 | 40 | 63.1 | 12081 |
| 14 | 37 | 30.8 | 2919 |
| 15 | 40 | 62 | 15000 |
| 40 | −30 | 61 | 15000 |
| 42 | −30 | 61 | 12055 |
| 46 | −30 | 61 | 10742 |
| 52 | −107.5 | 18 | 1314 |
| 56 | −38 | 39.7 | 2944 |
| 60 | −38 | 39.7 | 2215 |
| 64 | −107.4 | 18 | 729 |
| 80 | 8.2 | 18 | 2919 |
| 82 | −109.9 | 17.8 | 19021 |
| 84 | 37.4 | 16.8 | 19021 |
| 86 | 40 | 63.1 | 19021 |
| 88 | 40 | 63.1 | 6940 |
| 90 | −45 | 62.6 | 6940 |
| 94 | −111 | 18 | 3440 |
| 96 | −45 | 62.6 | 3500 |
| 100 | −33.9 | 61 | 14242 |
| 102 | −84.1 | 17.9 | 14242 |

Figure 2:
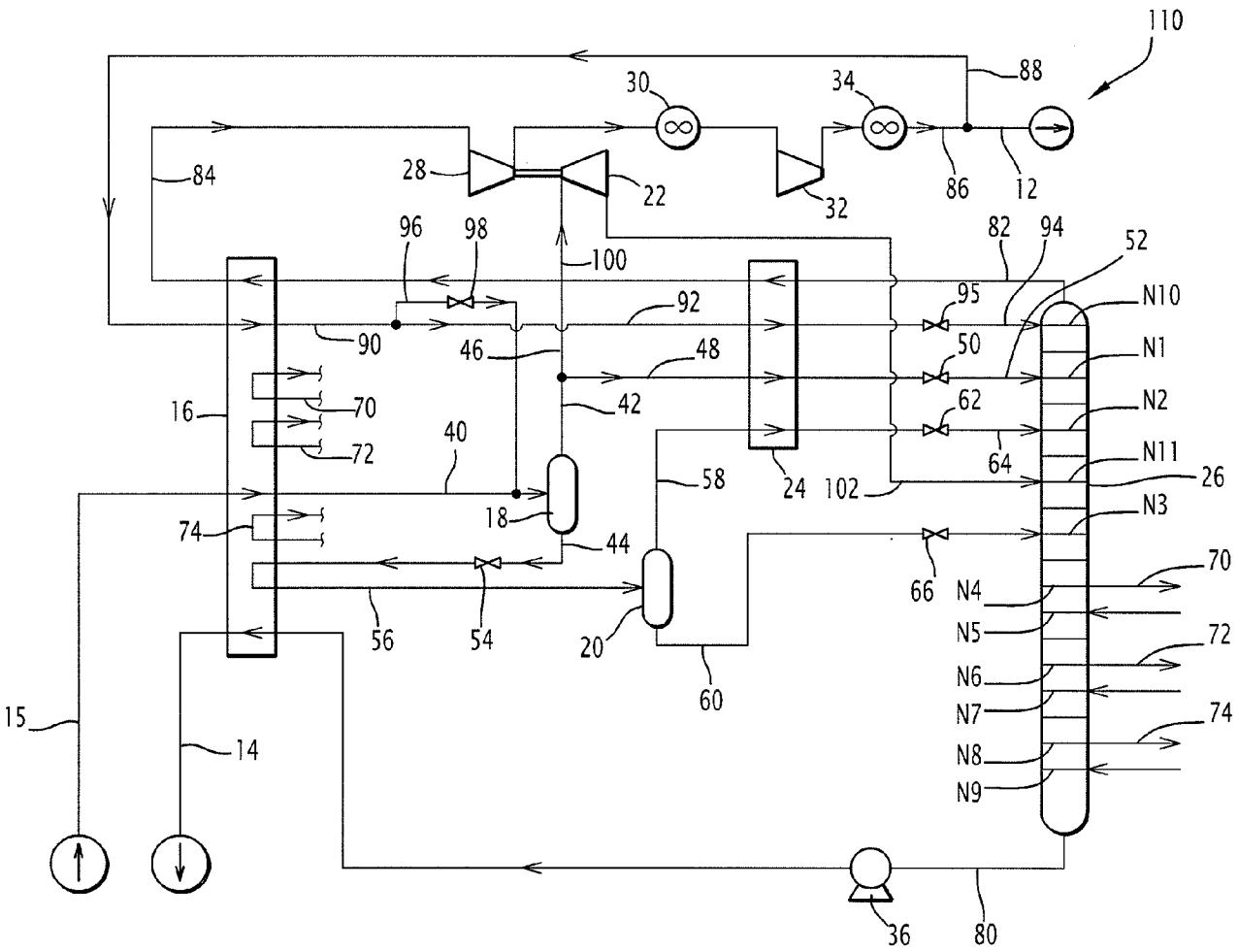
FIG. 2 is a view similar to FIG. 1 of a second installation according to the invention for carrying out a second method according to the invention.

A second installation 110 according to the invention is illustrated in FIG. 2. The second illustration 110 is intended for carrying out a second method according to the invention.

Unlike the first method according to the invention, the second portion 96 of the first cooled recirculation flow 90 forming the second recirculation flow is reintroduced, after expansion in the control valve 98, upstream of the column 26, in the cooled, feed natural gas flow 40, between the first exchanger 16 and the first separation flask 18.

In this example, the second flow 96 contributes to the formation of the light fraction 42 and the formation of the supply flow for the first expansion turbine 22.

In this example, the flow 100 is further formed only by the supply flow 46.

As illustrated in Table 3 below, this allows further slight improvement in the efficiency of the installation.

TABLE 3

| Recovery of ethane mol % | Flow rate of second recycled flow 96 at turbine 22 kgmol/h | Power of compressor 32 kW | Pressure of column 26 bar |
|---|---|---|---|
| 99.22 | 0 | 20310 | 14.30 |
| 99.24 | 100 | 20190 | 14.50 |

TABLE 3-continued

| Recovery of ethane mol % | Flow rate of second recycled flow 96 at turbine 22 kgmol/h | Power of compressor 32 kW | Pressure of column 26 bar |
|---|---|---|---|
| 99.24 | 500 | 20140 | 15.00 |
| 99.22 | 1000 | 20020 | 15.50 |
| 99.22 | 1500 | 19930 | 16.00 |
| 99.23 | 2000 | 19880 | 16.50 |
| 99.20 | 2500 | 19800 | 17.00 |
| 99.23 | 3000 | 19800 | 17.50 |
| 99.26 | 3500 | 19850 | 18.00 |

Examples of temperature, pressure and molar flow rate of the various flows illustrated in the method of FIG. 2 are set out in Table 4 below.

TABLE 4

| Flow | Temperature (° C.) | Pressure (bar) | Flow rate (kgmol/h) |
|---|---|---|---|
| 12 | 40 | 63.1 | 12083 |
| 14 | 37 | 30.8 | 2920 |
| 15 | 40 | 62 | 15000 |
| 40 | −30 | 61 | 15000 |
| 42 | −33.2 | 61 | 15223 |
| 46, 100 | −33.2 | 61 | 13873 |
| 52 | −108.6 | 17.5 | 1350 |
| 56 | −38 | 39.7 | 2777 |
| 60 | −38 | 39.7 | 2003 |
| 64 | −108.2 | 17.5 | 777 |
| 80 | 6.9 | 17.5 | 2920 |
| 82 | −110.6 | 17.3 | 18483 |
| 84 | 37.6 | 16.3 | 18483 |
| 86 | 40 | 63.1 | 18483 |
| 88 | 40 | 63.1 | 6400 |
| 90 | −45 | 62.6 | 6400 |
| 94 | −111.7 | 17.5 | 3400 |
| 96 | −45 | 62.6 | 3000 |
| 102 | −82.6 | 17.4 | 13873 |

Figure 3:
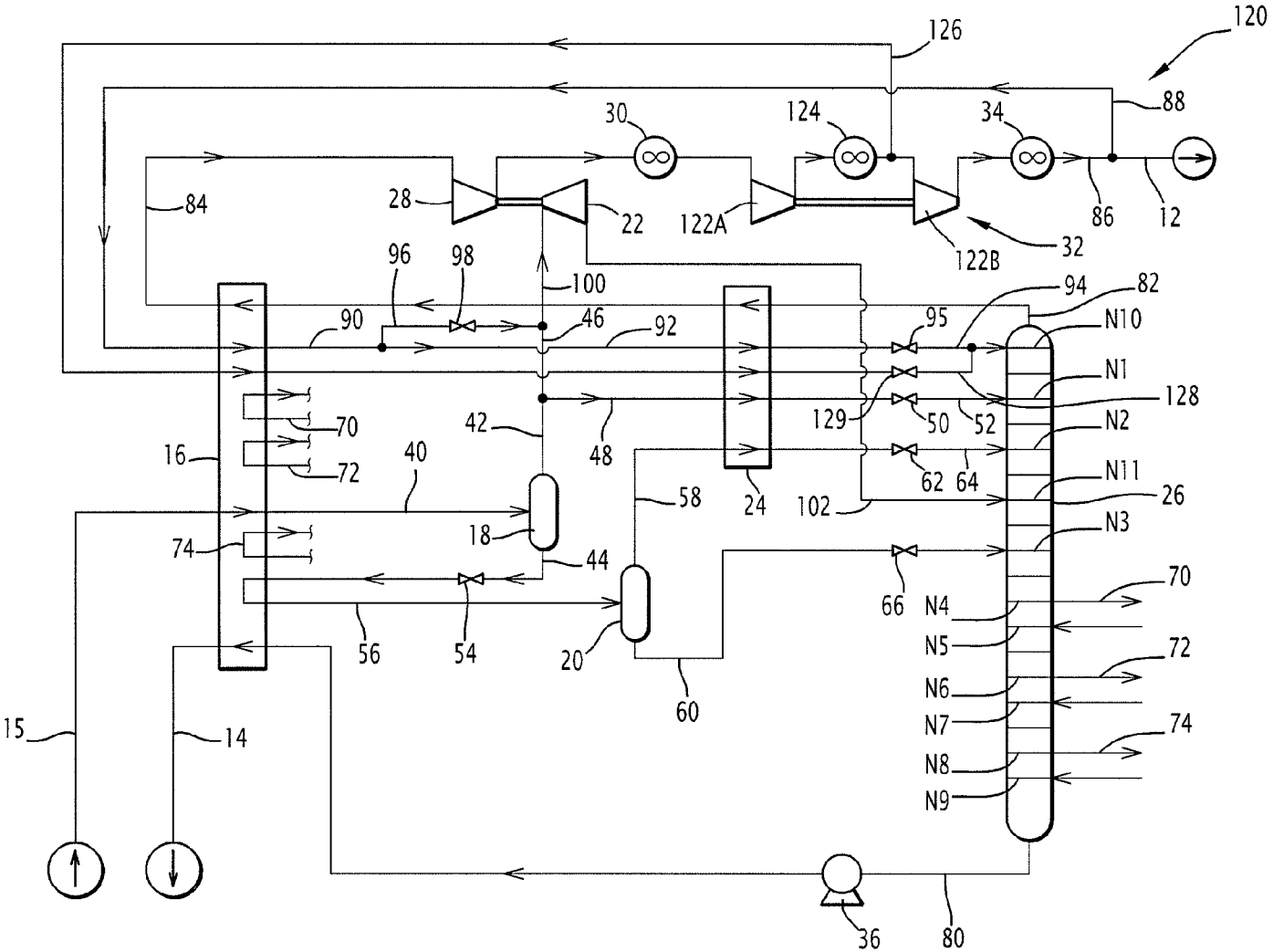
FIG. 3 is a view similar to FIG. 1 of a third installation according to the invention for carrying out a third method according to the invention.

A third installation 120 according to the invention is illustrated in FIG. 3.

That third installation 120 is intended for carrying out a third method according to the invention.

Unlike the first installation, the second compressor 32 of the third installation 120 comprises two compression stages 122A, 122B and an intermediate air cooler 124 which is interposed between the two stages.

Unlike the first method according to the invention, the third method according to the invention comprises the removal of a third recirculation flow 126 from the reheated head flow 84 rich in methane. The third recirculation flow 126 is removed between the two stages 122A, 122B at the outlet of the intermediate coolant 124. In this manner, the flow 126 has a pressure greater than 30 bar and in particular of 34.3 bar and a temperature substantially equal to ambient temperature and in particular substantially of 40° C.

The ratio of the flow rate of the third recirculation flow to the total flow rate of the reheated head flow 84 rich in methane from the first heat exchanger 16 is less than 0.1 and is particularly between 0.08 and 0.1.

The third recirculation flow 126 is subsequently introduced successively into the first exchanger 16, then into the second exchanger 24 in order to be cooled to a temperature greater than −110° C. and in particular substantially of −107.6° C.

The flow 128, obtained after expansion in a control valve 129, is subsequently reintroduced into admixture with the first portion 94 of the first cooled recirculation flow 90 between the control valve 95 and the column 26.

Table 5 illustrates the effect of the presence of the third recirculation flow 126. A reduction in the power consumed of 11.8% compared with the prior art is observed, of which approximately 3% is because of the liquefaction at mean pressure of the third recirculation flow 126.

TABLE 5

| Recovery of ethane mol % | Recycled flow rate at turbine 22 kgmol/h | Power of compressor 32 kW | Pressure of column 26 bar | Flow rate of flow 126 of liquefied methane at mean pressure kgmol/h |
|---|---|---|---|---|
| 99.14 | 3500 | 18470 | 18 | 0 |
| 99.14 | 3500 | 18210 | 18 | 1000 |
| 99.14 | 3500 | 17910 | 18 | 2000 |

Examples of temperature, pressure and mass flow rate of the various flows illustrated in the method of FIG. 3 are set out in Table 6 below.

TABLE 6

| Flow | Temperature (° C.) | Pressure (bar) | Flow rate (kgmol/h) |
|---|---|---|---|
| 12 | 40 | 62.6 | 12082 |
| 14 | 37 | 30.8 | 2918 |
| 15 | 40 | 62 | 15000 |
| 40 | −30 | 61 | 15000 |
| 42 | −30 | 61 | 12055 |
| 46 | −30 | 61 | 11225 |
| 52 | −107.5 | 18 | 830 |
| 56 | −38 | 39.7 | 2944 |
| 60 | −38 | 39.7 | 2215 |
| 64 | −107.4 | 18 | 729 |
| 80 | 8.2 | 18 | 2918 |
| 82 | −109.9 | 17.8 | 19622 |
| 84 | 37.2 | 16.8 | 19622 |
| 86 | 40 | 62.6 | 17622 |
| 88 | 40 | 62.6 | 5540 |
| 90 | −45 | 62.1 | 5540 |
| 94 | −111 | 18 | 2040 |
| 96 | −45 | 62.1 | 3500 |
| 100 | −33.7 | 61 | 14725 |
| 102 | −83.7 | 17.9 | 14725 |
| 126 | 40 | 34.3 | 2000 |
| 128 | −111 | 18 | 2000 |

Figure 4:
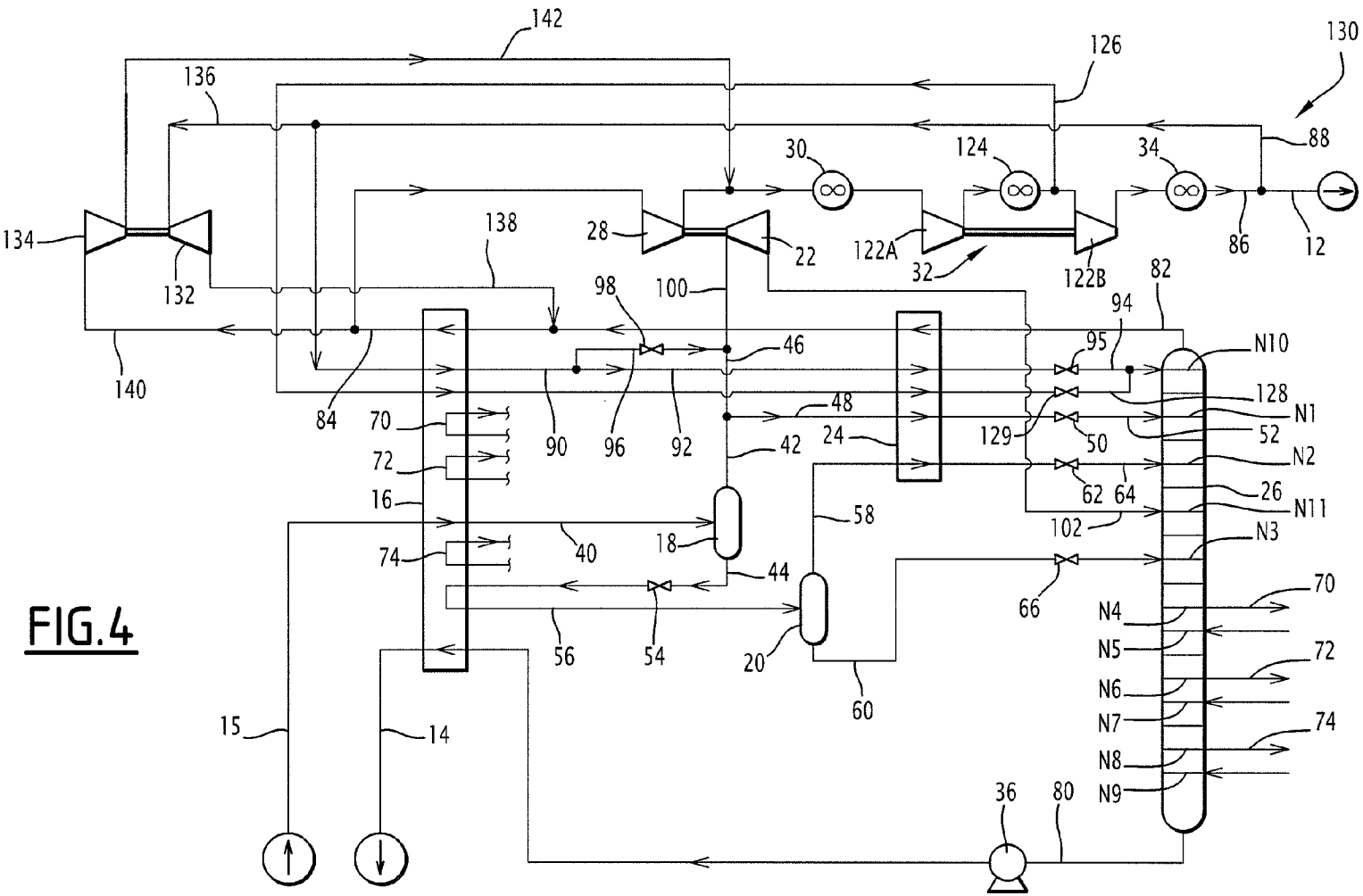
FIG. 4 is a view similar to FIG. 1 of a fourth installation according to the invention for carrying out a fourth method according to the invention.

A fourth installation 130 according to the invention is illustrated in FIG. 4. The fourth installation 130 is intended for carrying out a fourth method according to the invention.

The fourth installation 130 differs from the third installation 120 in that it comprises a second dynamic expansion turbine 132 connected to a third compressor 134.

The fourth method according to the invention comprises the removal of a fourth recirculation flow 136 from the first recirculation flow 88. The fourth recirculation flow 136 is removed from the first recirculation flow 88 downstream of the second compressor 32 and upstream of the introduction of the first recirculation flow 88 into the first exchanger 16 and the second exchanger 24.

The molar flow rate of the fourth recirculation flow 136 constitutes less than 70% of the molar flow rate of the first recirculation flow 88 removed at the outlet of the second compressor 32.

The fourth recirculation flow 136 is subsequently conveyed as far as the second dynamic expansion turbine 132 in order to be expanded at a pressure less than the pressure of the separation column 126 and in particular of 17.3 bar, and to produce frigories. The temperature of the fourth cooled recirculation flow 138 from the turbine 132 is thus less than −30° C. and in particular substantially of −36.8° C.

The fourth cooled recirculation flow 138 is subsequently reintroduced into the head flow 82 rich in methane between the outlet of the second exchanger 24 and the inlet of the first exchanger 16. In this manner, the frigories produced by the dynamic expansion in the turbine 132 are transmitted by heat exchange in the first exchanger 16 to the feed natural gas flow 15. The dynamic expansion allows 2293 kW of energy to be recovered.

A recompression fraction 140 is further removed from the reheated head flow 84 rich in methane between the outlet of the first exchanger 16 and the inlet of the first compressor 28. The recompression fraction 140 is introduced into the third compressor 134 which is connected to the second turbine 132 in order to be compressed as far as a pressure of less than 30 bar and in particular of 24.5 bar and a temperature of approximately 65° C. The compressed recompression fraction 142 is reintroduced into the cooled flow rich in methane between the outlet of the first compressor 28 and the inlet of the first air cooler 30.

The molar flow rate of the recompression fraction 140 is greater than 20% of the molar flow rate of the feed gas flow 15.

Table 7 illustrates the effect of the presence of the fourth recirculation flow 136. A reduction in the power consumed of 17.5% compared with the prior art is observed and 6.4% between the fourth installation 130 and the third installation 120.

TABLE 7

| Recovery of ethane mol % | Recycled flow rate at turbine 22 kgmol/h | Recycled flow rate at auxiliary turbine 132 kgmol/h | Power of compressor 32 kW | Pressure of column 26 bar | Flow rate of flow 126 kgmol/h |
|---|---|---|---|---|---|
| 99.14 | 3500 | 10 | 17920 | 18 | 2000 |
| 99.23 | 100 | 3700 | 16760 | 18 | 1600 |
| 99.16 | 0 | 3750 | 16770 | 18 | 1430 |

TABLE 8

| Flow | Temperature (° C.) | Pressure (bar) | Flow rate (kgmol/h) |
|---|---|---|---|
| 12 | 40 | 62.6 | 12083 |
| 14 | 37 | 30.7 | 2917 |
| 15 | 40 | 62 | 15000 |
| 40 | −30 | 61 | 15000 |
| 42 | −30 | 61 | 12055 |
| 46 | −30 | 61 | 11240 |
| 52 | −107.5 | 18 | 815 |
| 56 | −38 | 39.7 | 2944 |
| 60 | −38 | 39.7 | 2215 |
| 64 | −107.4 | 18 | 729 |
| 80 | 8.3 | 18 | 2917 |
| 82 | −109.9 | 17.8 | 15933 |
| 84 | 31.2 | 16.8 | 19633 |
| 86 | 40 | 62.6 | 18033 |
| 88 | 40 | 62.6 | 2250 |
| 90 | −45 | 62.1 | 2250 |
| 94 | −111 | 18 | 2150 |
| 96 | −45 | 62.1 | 100 |
| 100 | −30.1 | 61 | 11340 |
| 102 | −78.2 | 17.9 | 11340 |
| 126 | 40 | 34.3 | 1600 |
| 128 | −111 | 18 | 1600 |

TABLE 8-continued

| Flow | Temperature (° C.) | Pressure (bar) | Flow rate (kgmol/h) |
|---|---|---|---|
| 138 | −36.8 | 17.3 | 3700 |
| 142 | 65 | 24.5 | 6881 |

In a variant of the fourth method, the whole of the first cooled recirculation flow 90 from the first exchanger 16 is introduced into the second exchanger 24. The flow rate of the second portion 96 of the flow illustrated in FIG. 4 is zero.

In this variant, the second recirculation flow is formed by the fourth recirculation flow 136 which is conveyed as far as the dynamic expansion turbine 132 in order to produce frigories.

Carrying out this variant of the method according to the invention further does not require provision of a conduit allowing a portion of the first cooled recirculation flow 90 to be branched off towards the first turbine 22, so that the installation 130 can dispense with the feature.

Figure 5:
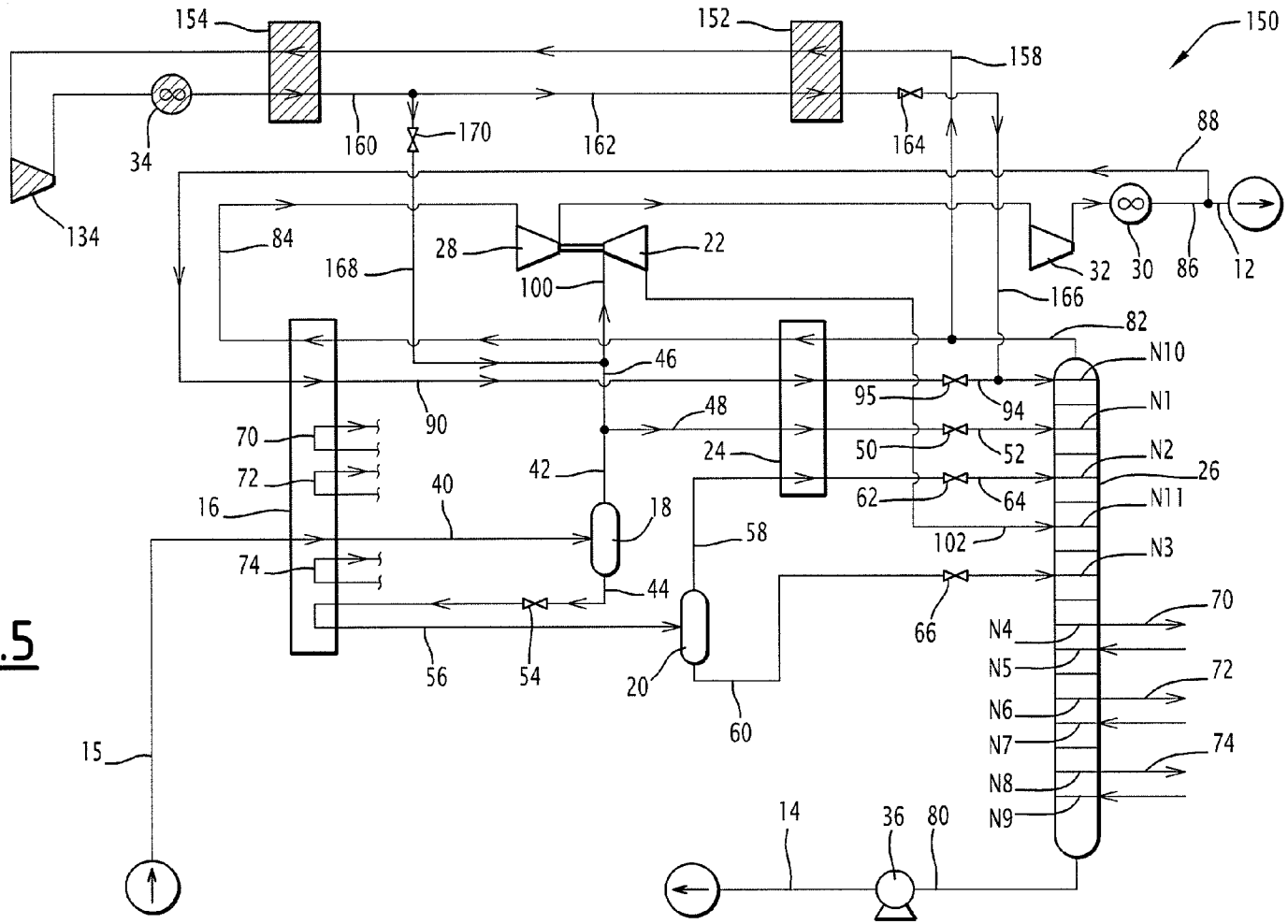
FIG. 5 is a view similar to FIG. 1 of a fifth installation according to the invention for carrying out a fifth method according to the invention.

A fifth installation 150 according to the invention is illustrated in FIG. 5. This fifth installation 150 is intended for carrying out a fifth method according to the invention.

This installation 150 is intended to improve an existing production unit of the prior art, as described, for example, in American U.S. Pat. No. 6,578,379, whilst keeping the power consumed by the second compressor 32 constant, in particular when the content of $C_2^+$ hydrocarbons in the feed gas 15 increases substantially.

The feed natural gas 15 is, in this example and those below, a dehydrated and decarbonated natural gas composed mainly of methane and $C_2^+$ hydrocarbons, comprising in moles 0.3499% of nitrogen, 89.5642% of methane, 5.2579% of ethane, 2.3790% of propane, 0.5398% of i-butane, 0.6597% of n-butane, 0.2399% of i-pentane, 0.1899% of n-pentane, 0.1899% of n-hexane, 0.1000% of n-heptane, 0.0300% of n-octane, 0.4998% of $CO_2$.

In the example set out, the cut of $C_2^+$ hydrocarbons always has the same composition, as indicated in Table 9:

TABLE 9

| | |
|---|---|
| Ethane | 54.8494 mol % |
| Propane | 24.8173 mol % |
| i-Butane | 5.6311 mol % |
| n-Butane | 6.8815 mol % |
| i-Pentane | 2.5026 mol % |
| n-Pentane | 1.9810 mol % |
| C6+ | 3.3371 mol % |
| Total | 100 mol % |

The fifth installation 150 according to the invention differs from the first installation 10 in that it comprises a third heat exchanger 152, a fourth heat exchanger 154 and a third compressor 134.

The installation further does not have an air cooler at the outlet of the first compressor 28. The first air cooler 30 is at the outlet of the second compressor 32.

However, it comprises a second air cooler 34 mounted at the outlet of the third compressor 134.

The fifth method according to the invention differs from the first method according to the invention in that a removal flow 158 is removed from the head flow 82 rich in methane between the outlet of the separation column 26 and the second heat exchanger 24.

The flow rate of the removal flow 158 is less than 15% of the flow rate of the head flow 82 rich in methane from the column 26.

The removal flow 158 is introduced successively into the third heat exchanger 152 in order to be reheated therein up to a first temperature less than ambient temperature, then in the fourth heat exchanger 154 in order to be reheated therein up to substantially ambient temperature.

The first temperature is further less than the temperature of the cooled feed natural gas flow 40 which supplies the first separation flask 18.

The flow 158 which is cooled in this manner is introduced into the third compressor 134 and into the cooler 34 in order to cool it as far as ambient temperature before it is introduced into the fourth heat exchanger 154 and to form a cooled, compressed removal flow 160.

The cooled, compressed removal flow 160 has a pressure greater than or equal to that of the feed gas flow 15. This pressure is less than 63 bar and substantially of 61.5 bar. The flow 160 has a temperature less than 40° C. and substantially of −40° C. This temperature is substantially equal to the temperature of the cooled, feed natural gas flow 40 which supplies the first separation flask 18.

The compressed cooled removal flow 160 is separated into a first portion 162 which is successively passed into the third heat exchanger 152 in order to be cooled therein as far as substantially the first temperature, then into a pressure control valve 164 in order to form a first cooled expanded portion 166.

The molar flow rate of the first portion 162 constitutes at least 4% of the molar flow rate of the feed natural gas flow 15.

The pressure of the first cooled expanded portion 166 is less than the pressure of the column 26 and is particularly of 20.75 bar.

The ratio of the molar flow rate of the first portion 162 to the molar flow rate of the cooled compressed removal flow 160 is greater than 0.25. The molar flow rate of the first portion 162 is greater than 4% of the molar flow rate of the feed natural gas flow 15.

A second portion 168 of the cooled compressed removal flow is introduced, after being passed into a static expansion valve 170, into admixture with the supply flow 46 of the first turbine 22 in order to form the supply flow 100 of the turbine 22.

In this manner, the second portion 168 constitutes the second recirculation flow according to the invention which is introduced into the turbine 22 in order to produce frigories at that location.

In a variant (not illustrated), the second portion 168 is introduced into the cooled, feed natural gas flow 40 upstream of the first separation flask 18, as illustrated in FIG. 2.

Table 10 illustrates the powers consumed by the compressor 32 and the compressor 134 in accordance with the $C_2^+$ cut flow rate present in the feed natural gas.

This table confirms that it is possible to retain the second compressor 32, without modifying its size, for a production installation receiving a gas which is richer in $C_2^+$ hydrocarbons, without impairing the recovery of ethane.

TABLE 10

| Increase in the $C_2^+$ content in the feed flow mol % | Recovery of ethane mol % | Power of compressor 32 kW | Power of turbine 22 kW | Cut flow rate $C_2^+$ in feed flow 15 kgmol/h | Power of compressor 134 kW |
|---|---|---|---|---|---|
| 0 | 99.20 | 12120 | 3087 | 1438 | 0 |
| 10 | 99.24 | 12150 | 3276 | 1582 | 963.9 |
| 20 | 99.19 | 12140 | 3444 | 1726 | 1789 |
| 30 | 99.21 | 12160 | 3599 | 1870 | 2677 |

Examples of temperature, pressure and mass flow rate of the different flows illustrated in the method of FIG. 5 are set out in Table 11 below.

TABLE 11

| Flow | Temperature (° C.) | Pressure (bar) | Flow rate (kgmol/h) |
|---|---|---|---|
| 12 | 40 | 63.1 | 13072 |
| 14 | 14.6 | 25.8 | 1928 |
| 15 | 24 | 62 | 15000 |
| 40 | −42 | 61 | 15000 |
| 42 | −42 | 61 | 12903 |
| 46 | −42 | 61 | 10503 |
| 52 | −104.6 | 20.8 | 2400 |
| 56 | −38 | 39.7 | 2097 |
| 60 | −38 | 39.7 | 1301 |
| 64 | −104.4 | 20.8 | 796 |
| 80 | 14.1 | 20.8 | 1928 |
| 82 | −106.7 | 20.6 | 16322 |
| 84 | 20.8 | 19.6 | 14022 |
| 86 | 40 | 63.1 | 14022 |
| 88 | 40 | 63.1 | 950 |
| 90 | −45 | 62.6 | 950 |
| 94 | −107.3 | 20.8 | 950 |
| 100 | −42 | 61 | 12090 |
| 102 | −87.7 | 20.6 | 12090 |
| 158 | −106.7 | 20.6 | 2300 |
| 160 | −40 | 61.5 | 2300 |
| 166 | −104.7 | 20.8 | 713 |
| 168 | −40 | 61.5 | 1587 |

A secondary branch flow 186 is further removed from the first portion 162 of the cooled, compressed removal flow 160 before being introduced into the third exchanger 152.

The secondary branch flow 186 is subsequently conveyed as far as the second expansion turbine 132 in order to be expanded as far as a pressure less than 25 bar and in particular substantially of 23 bar, which lowers its temperature to less than −90° C. and in particular to 94.6° C.

The expanded secondary branch flow 188 which is formed in this manner is introduced in admixture into the removal flow 158 before it is introduced into the third exchanger 152.

The flow rate of the secondary branch flow is less than 75% of the flow rate of the flow 160 taken at the outlet of the fourth exchanger 154.

As Table 12 below shows, it is thereby possible to increase the $C_2^+$ content in the feed flow without modifying the power consumed by the compressor 32, or modifying the power developed by the first expansion turbine 22, whilst still minimising the power consumed by the compressor 134.

TABLE 12

| Increase in $C_2^+$ content in feed flow mol % | Recovery of ethane mol % | Power of compressor 32 kW | Power of turbine 22 kW | Cut flow rate $C_2^+$ in the feed flow 15 kgmol/h | Power of compressor 134 kW | Power of turbine 132 kW |
|---|---|---|---|---|---|---|
| 0 | 99.20 | 12120 | 3087 | 1438 | 0 | 0 |
| 10 | 99.25 | 12111 | 3072 | 1582 | 913.3 | 228 |
| 20 | 99.27 | 12100 | 3064 | 1726 | 1740 | 417 |
| 30 | 99.17 | 12130 | 3053 | 1870 | 2481 | 569 |

Figure 6:
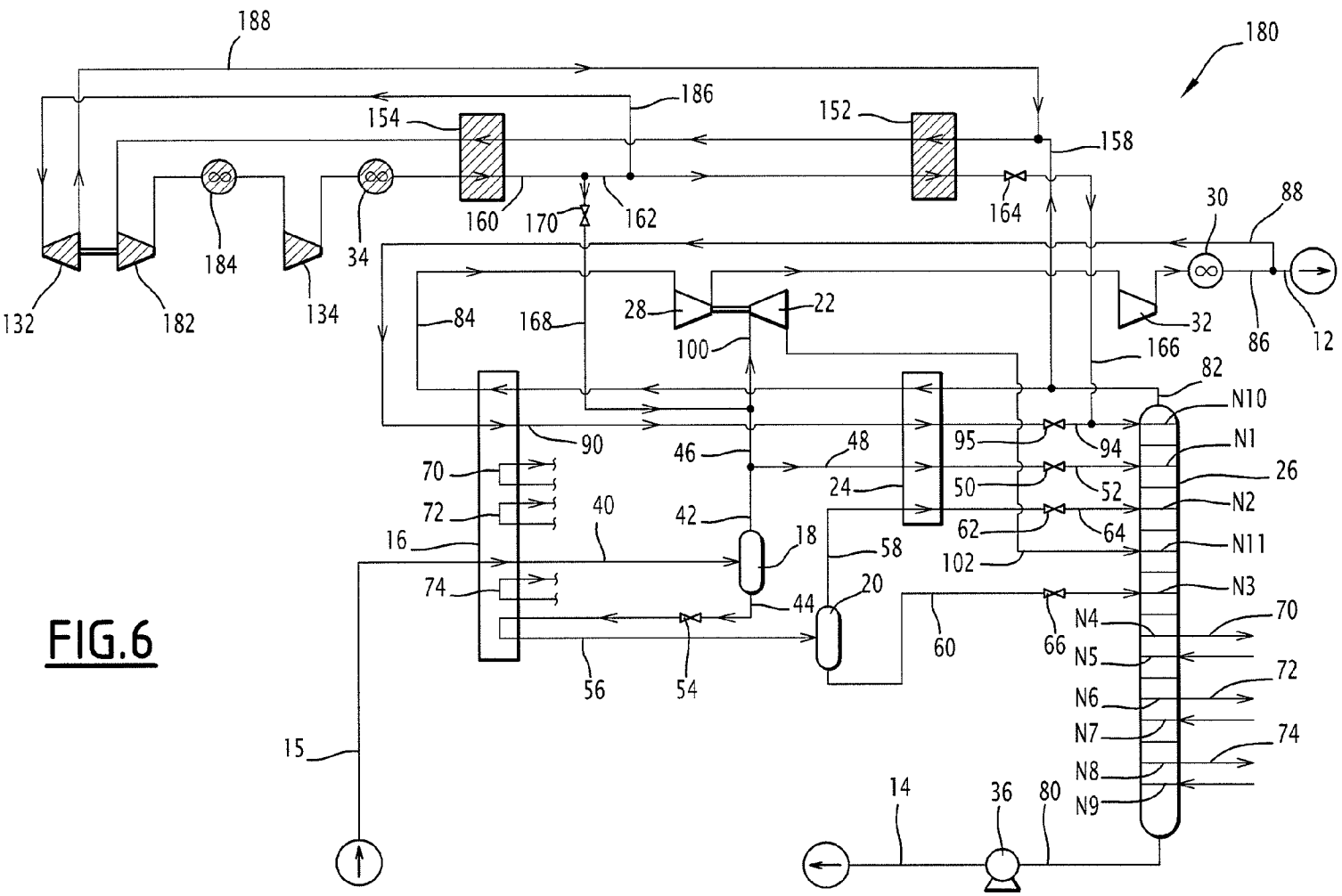
FIG. 6 is a view similar to FIG. 1 of a sixth installation according to the invention for carrying out a sixth method according to the invention.

A sixth installation 180 according to the invention is illustrated in FIG. 6. The sixth installation 180 is intended for carrying out a sixth method according to the invention.

The sixth installation 180 differs from the fifth installation 150 in that it further comprises a fourth compressor 182, a second expansion turbine 132 which is connected to the fourth compressor 182 and a third air cooler 184.

Unlike the fifth method, the removal flow 158 is introduced, after it has passed into the fourth exchanger 154, successively into the fourth compressor 182, into the third air cooler 184 before being introduced into the third compressor 134.

Examples of temperature, pressure and mass flow rate of the various flows illustrated in the method of FIG. 6 are set out in Table 13 below.

TABLE 13

| Flow | Temperature (° C.) | Pressure (bar) | Flow rate (kgmol/h) |
|---|---|---|---|
| 12 | 40 | 63.1 | 13071 |
| 14 | 15.7 | 26.3 | 1929 |
| 15 | 24 | 62 | 15000 |
| 40 | −42 | 61 | 15000 |
| 42 | −42 | 61 | 12903 |

TABLE 13-continued

| Flow | Temperature (° C.) | Pressure (bar) | Flow rate (kgmol/h) |
|---|---|---|---|
| 46 | −42 | 61 | 10503 |
| 52 | −104 | 21.3 | 2400 |
| 56 | −38 | 39.7 | 2097 |
| 60 | −38 | 39.7 | 1301 |
| 64 | −103.8 | 21.3 | 796 |
| 80 | 15.2 | 21.3 | 1929 |
| 82 | −106.1 | 21 | 14671 |
| 84 | 19.7 | 20.1 | 13921 |
| 86 | 40 | 63.1 | 13921 |
| 88 | 40 | 63.1 | 850 |
| 90 | −45 | 62.6 | 850 |
| 94 | −106.6 | 21.3 | 850 |
| 100 | −42 | 61 | 10503 |
| 102 | −85.6 | 21.1 | 10503 |
| 158 | −106.1 | 21 | 750 |
| 160 | −42 | 61.5 | 2778 |
| 166 | −106.5 | 21.3 | 750 |
| 168 | −42 | 61.5 | 750 |
| 188 | −94.6 | 23 | 2028 |

Figure 7:
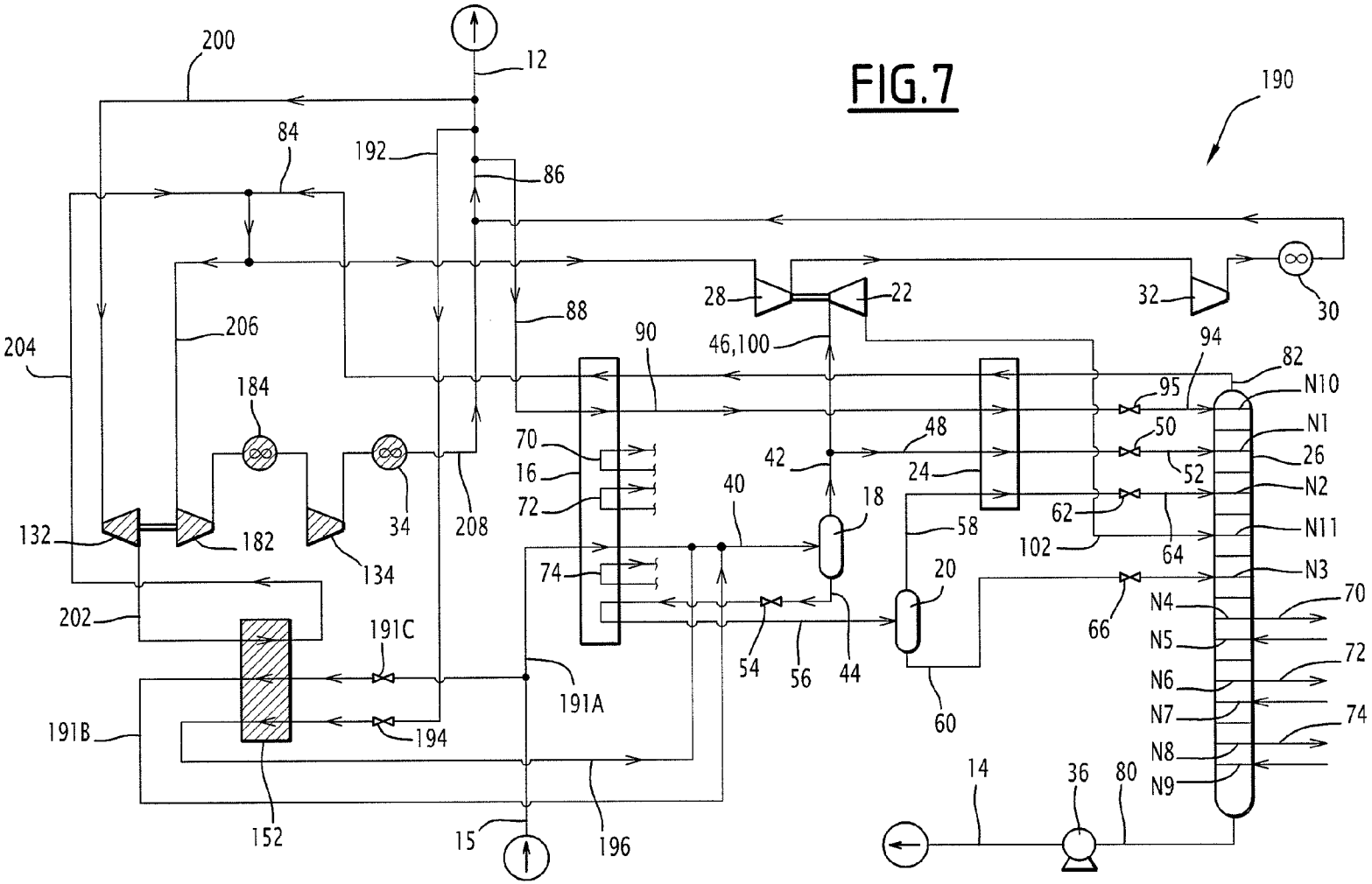
FIG. 7 is a view similar to FIG. 1 of a seventh installation according to the invention for carrying out a seventh method according to the invention.

A seventh installation 190 according to the invention is illustrated in FIG. 7. This seventh installation is intended for carrying out a seventh method according to the invention.

The seventh installation 190 differs from the second installation 110 owing to the presence of a third heat exchanger 152, the presence of a third compressor 134 and a second air cooler 34, and the presence of a fourth compressor 182 which is connected to a third air cooler 184. The fourth compressor 182 is further connected to a second expansion turbine 132.

The seventh method according to the invention differs from the second method according to the invention in that the second recirculation flow is formed by a removal fraction 192 taken from the compressed head flow 86 rich in methane downstream of the location where the first recirculation flow 88 is removed.

The removal fraction 192 is subsequently conveyed as far as the third heat exchanger 152, after being introduced into a valve 194 in order to form an expanded cooled removal fraction 196. The fraction 196 has a pressure less than 63 bar and in particular of 61.5 bar and a temperature less than 40° C. and in particular of −20.9° C.

The flow rate of the removal fraction 192 is less than 1% of the flow rate of the flow 82 taken at the outlet of the column 26.

The feed natural gas flow 15 is separated into a first feed flow 191A which is conveyed as far as the first heat exchanger 16 and a second feed flow 191B which is conveyed as far as the third heat exchanger 152 by flow rate control by the valve 191C. The feed flows 191A, 191B, after they are cooled in the exchangers 16, 152, are mixed together at the outlet of the exchangers 16 and 152, respectively, in order to form the cooled feed natural gas flow 40 before it is introduced into the first separation flask 18.

The ratio of the flow rate of the feed flow 191A to the flow rate of the feed flow 191B is between 0 and 0.5.

The removed fraction 196 is introduced into the first feed flow 191A at the outlet of the first exchanger 16 before it is mixed with the second feed flow 191B.

A secondary cooling flow 200 is removed from the compressed head flow 86 rich in methane downstream of the location where the removal fraction 192 is removed.

The secondary cooling flow 200 is transferred as far as the dynamic expansion turbine 132 in order to be expanded as far as a pressure less than the pressure of the column 26, and in particular of 22 bar, and to provide frigories. The secondary expanded cooling flow 202 from the turbine 132 is subsequently introduced, at a temperature less than 40° C. and in particular of −23.9° C., into the third exchanger 152 in order to become reheated therein by heat exchange with the flows 191B and 192 substantially up to ambient temperature.

Subsequently, the reheated secondary cooling flow 204 is reintroduced into the head flow 82 rich in methane at the outlet of the first exchanger 16 before it is introduced into the first compressor 28.

A recompression fraction 206 is further removed from the reheated head flow 84 rich in methane downstream of the introduction of the reheated secondary cooling flow 204, then is successively introduced into the fourth compressor 182, the third air cooler 184, the third compressor 134, then into the second air cooler 34. The fraction 208 is subsequently reintroduced into the compressed head flow 86 rich in methane from the second compressor 32 upstream of the location where the first recirculation flow 88 is removed.

The compressed flow 86 rich in methane which is from the cooler 30 and receives the fraction 208 is advantageously at ambient temperature.

As Table 14 illustrates below, the seventh method according to the invention allows the compressor 32 and the turbine 22 to be kept identical when the content of ethane and the contents of $C_3^+$ hydrocarbons in the feed gas increase, whilst achieving recovery of ethane greater than 99%.

The output of this method is further improved over that of the sixth method according to the invention, with a constant content of $C_2^+$ hydrocarbons. This becomes increasingly the case as the content of $C_2^+$ hydrocarbons in the feed gas increases.

TABLE 14

| Increase in $C_2^+$ content in feed flow mol % | Recovery of ethane mol % | Power of compressor 32 kW | Power of turbine 22 kW | Cut flow rate $C_2^+$ in feed flow kgmol/h | Power of compressor 134 kW | Power of turbine 132 kW |
|---|---|---|---|---|---|---|
| 0 | 99.20 | 12120 | 3087 | 1438 | 0 | 0 |
| 10 | 99.21 | 12130 | 3054 | 1582 | 682 | 983.5 |
| 20 | 99.24 | 12140 | 3997 | 1726 | 1375 | 2119 |
| 30 | 99.18 | 12130 | 3974 | 1870 | 2213 | 3531 |
| 40 | 99.21 | 12170 | 2969 | 2031 | 3097 | 4629 |

Examples of temperature, pressure and mass flow rate of the various flows illustrated in the method of FIG. 7 are set out in Table 15 below:

TABLE 15

| Flow | Temperature (° C.) | Pressure (bar) | Flow rate (kgmol/h) |
|---|---|---|---|
| 12 | 39.8 | 62 | 12923 |
| 14 | 20.5 | 27.7 | 2077 |
| 15 | 24 | 62 | 15000 |
| 40 | −42 | 61 | 15100 |
| 42 | −42 | 61 | 12658 |
| 46, 100 | −42 | 61 | 10878 |
| 52 | −102.2 | 22.7 | 1780 |
| 56 | −38 | 39.7 | 2442 |
| 60 | −38 | 39.7 | 1501 |
| 64 | −101.9 | 22.7 | 940 |
| 80 | 20 | 22.7 | 2077 |
| 82 | −104.2 | 22.5 | 14923 |
| 84 | 3.6 | 21.5 | 14923 |
| 86 | 40 | 62 | 23923 |
| 88 | 40 | 62 | 1900 |
| 90 | −45 | 61.5 | 1900 |
| 94 | −104.8 | 22.7 | 1900 |
| 102 | −83.1 | 22.6 | 10878 |
| 191A | 24 | 62 | 10500 |
| 191B | −21.1 | 61 | 4500 |
| 196 | −20.9 | 61.5 | 100 |
| 202 | −23.9 | 22 | 9000 |
| 208 | 40 | 62 | 8300 |

What is claimed is:

1. A method for producing a flow which is rich in methane and a cut which is rich in $C_2^+$ hydrocarbons from a flow of dehydrated feed natural gas, which is composed of hydrocarbons, nitrogen and CO2 and which advantageously has a molar content of $C_2^+$ hydrocarbons greater than 10%, the method comprising the following steps of:

cooling the feed natural gas flow advantageously at a pressure greater than 40 bar in a first heat exchanger and introducing the cooled, feed natural gas flow into a first separation flask;

separating the cooled natural gas flow in the first separation flask and recovering a light fraction which is substantially gaseous and a heavy fraction which is substantially liquid;

dividing the light fraction into a flow for supplying to a turbine and a secondary flow;

dynamic expansion of the turbine supply flow in a first expansion turbine and introducing the expanded flow into an intermediate portion of a separation column;

cooling the secondary flow in a second heat exchanger and introducing the cooled secondary flow into an upper portion of the separation column;

expanding the heavy fraction, vaporization in the first heat exchanger and introduction into a second separation flask in order to form a head fraction and a bottom fraction;

introducing the head fraction, after cooling in the second heat exchanger, in the upper portion of the separation column;

introducing the bottom fraction into an intermediate portion of the separation column;

recovering, at the bottom of the separation column, a bottom flow which is rich in $C_2^+$ hydrocarbons and which is intended to form the cut rich in $C_2^+$ hydrocarbons;

removing, at the head of the separation column, a head flow rich in methane;

reheating the head flow rich in methane in the second heat exchanger and in the first heat exchanger and compressing the head flow rich in methane in at least a first compressor and in a second compressor in order to form a flow rich in methane from the compressed head flow rich in methane;

removing a first recirculation flow from the head flow rich in methane;

passing the first recirculation flow into the first heat exchanger and into the second heat exchanger in order to cool the first recirculation flow, then introducing at least a first portion of the first cooled recirculation flow into the upper portion of the separation column; wherein the method comprises the following steps of:

forming a dynamic expansion flow from a second recirculation flow from the head flow rich in methane and introducing the dynamic expansion flow into the first expansion turbine in order to produce a cooling thermal power, said cooling thermal power being introduced into the separation column, the method comprising:

removing a removal flow from the head flow rich in methane, before the head flow rich in methane is introduced into the first compressor and the second compressor;

compressing the removal flow in a third compressor;

forming the second recirculation flow from the compressed removal flow from the third compressor, after cooling.

2. The method according to claim 1, wherein the second recirculation flow is introduced into a flow downstream of the first heat exchanger and upstream of the first expansion turbine in order to form the dynamic expansion flow.

3. The method according to claim 2, wherein the second recirculation flow is mixed with the turbine supply flow from the first separation flask in order to firm the dynamic expansion flow, the dynamic expansion turbine receiving the dynamic expansion flow being formed by the first expansion turbine.

4. Method according to claim 2, wherein the second recirculation flow is mixed with the cooled natural gas flow before the second recirculation flow is introduced into the first separation flask, the dynamic expansion flow being formed by the turbine supply flow from the first separation flask.

5. The method according to claim 1, further comprising passing the removal flow into a third heat exchanger and into a fourth heat exchanger before the removal flow is introduced into the third compressor, then passing the compressed removal flow into the fourth heat exchanger, then into the third heat exchanger in order to supply the head of the separation column, the second recirculation flow being removed from the cooled, compressed removal flow, between the fourth heat exchanger and the third heat exchanger.

6. The method according to claim 1, wherein the removal flow is introduced into a fourth compressor, the method comprising the following steps of:

removing a secondary branch flow from the cooled, compressed removal flow from the third compressor and the fourth compressor;

dynamic expansion of the secondary branch flow in a second expansion turbine which is connected to the fourth compressor;

introducing the expanded secondary branch flow into the removal flow before the removal flow is passed into the third compressor and into the fourth compressor.

7. An installation for producing a flow rich in methane and a cut rich in $C_2^+$ hydrocarbons from a dehydrated feed natural gas flow which is composed of hydrocarbons, nitrogen and CO2 and which advantageously has a molar content of $C_2^+$ hydrocarbons greater than 10%, the installation comprising:

a first heat exchanger for cooling the feed natural gas flow which advantageously flows at a pressure greater than 40 bar;

a first separation flask;

an apparatus for introducing the cooled feed natural gas flow into the first separation flask, the flow of cooled natural gas being separated in the first separation flask in order to recover a light, substantially gaseous fraction and a heavy, substantially liquid fraction;

an apparatus for dividing the light fraction into a flow for supplying a turbine and a secondary flow;

a first dynamic expansion turbine for the turbine supply flow;

a separation column;

an apparatus for introducing the expanded flow into the first dynamic expansion turbine in an intermediate portion of the separation column;

a second heat exchanger for cooling the secondary flow and an apparatus for introducing the cooled secondary flow in an upper portion of the separation column;

an apparatus for expanding the heavy fraction and an apparatus for passing the heavy fraction through the first heat exchanger;

a second separation flask;

an apparatus for introducing the heavy fraction from the first heat exchanger into the second separation flask in order to form a head fraction and a bottom fraction;

an apparatus for introducing the head fraction, after it has been introduced into the second exchanger to cool the head fraction, into the upper portion of the separation column;

an apparatus for introducing the bottom fraction into an intermediate portion of the separation column;

an apparatus for recovering, at the bottom of the separation column, a bottom flow which is rich in $C_2^+$ hydrocarbons and which is intended to form the cut rich in $C_2^+$ hydrocarbons;

an apparatus for removing, at the head of the separation column, a head flow rich in methane;

an apparatus for introducing the head flow rich in methane into the second heat exchanger and into the first heat exchanger in order to reheat the head flow rich in methane;

an apparatus for compressing the head flow rich in methane comprising at least a first compressor and a second compressor in order to form the flow rich in methane from the compressed head flow rich in methane;

an apparatus for removing a first recirculation flow from the head flow rich in methane;

an apparatus for introducing the first recirculation flow into the first heat exchanger then into the second heat exchanger in order to cool the first recirculation flow;

an apparatus for introducing at least a portion of the first cooled recirculation flow into the upper portion of the separation column;

wherein the installation comprises:

an apparatus for forming a dynamic expansion flow from a second recirculation flow from the head flow rich in methane;

an apparatus for passing the dynamic expansion flow through the first dynamic expansion turbine in order to produce a cooling thermal power, said cooling thermal power being introduced into the separation column;

a third compressor that receives a removal flow from the head flow rich in methane before the head flow rich in methane is introduced into the first compressor and the second compressor, and forms the second recirculation flow by compressing the removal flow after cooling.

8. The installation according to claim 7, wherein the apparatus for forming a dynamic expansion flow from the second recirculation flow comprise an apparatus for introducing the second recirculation flow into a flow which flows downstream of the first heat exchanger and upstream of the first expansion turbine in order to form the dynamic expansion flow.

* * * * *